US010436082B2

(12) United States Patent
Bucher

(10) Patent No.: US 10,436,082 B2
(45) Date of Patent: Oct. 8, 2019

(54) METHOD FOR OPERATING A GEAR PUMP, AND GEAR PUMP

(71) Applicant: MAN Truck & Bus AG, München (DE)

(72) Inventor: Simon Bucher, Wassertrüdingen (DE)

(73) Assignee: MAN TRUCK & BAG AG, München (DE)

( * ) Notice: Subject to any disclaimer, the term of this patent is extended or adjusted under 35 U.S.C. 154(b) by 590 days.

(21) Appl. No.: 15/013,019

(22) Filed: Feb. 2, 2016

(65) Prior Publication Data

US 2016/0230620 A1 Aug. 11, 2016

(30) Foreign Application Priority Data

Feb. 3, 2015 (DE) ..... 10 2015 001 235

(51) Int. Cl.
*F01M 1/02* (2006.01)
*F04C 2/08* (2006.01)
(Continued)

(52) U.S. Cl.
CPC ..... *F01M 1/02* (2013.01); *F04C 2/084* (2013.01); *F04C 2/102* (2013.01); *F04C 2/14* (2013.01);
(Continued)

(58) Field of Classification Search
CPC ..... F01M 1/02; F01M 2001/0238; F01M 2001/0246; F04C 14/00; F04C 14/22;
(Continued)

(56) References Cited

U.S. PATENT DOCUMENTS 4,951,790 A * 8/1990 Blything ..... F16D 31/04 192/61
5,056,994 A * 10/1991 Eisenmann ..... F04C 2/103 418/61.3
(Continued)

FOREIGN PATENT DOCUMENTS

DE 1231563 B 12/1966
DE 197 46 768 A1 12/2000
(Continued)

*Primary Examiner* — Mary Davis
*Assistant Examiner* — Dapinder Singh
(74) *Attorney, Agent, or Firm* — Lucas & Mercanti, LLP

(57) ABSTRACT

The invention concerns a method for operating a gear pump, in particular for delivering engine oil in an oil circuit of a vehicle, wherein a delivery device is provided with at least two gear wheels, in particular with external toothing or configured as spur gears and arranged in a housing, wherein by means of the gear wheels a fluid to be conveyed can be delivered starting from at least one housing inlet through to at least one housing outlet, and wherein the gear wheels are arranged behind each other viewed in the axial direction (x). According to the invention, an adjustment device is provided, by means of which the gear wheels can be twisted and/or displaced relative to each other depending on the pressure conditions inside the housing, in particular depending on the vacuum pressure at the housing inlet and/or depending on the fluid back-pressure at the housing outlet.

17 Claims, 5 Drawing Sheets

(51) Int. Cl.

| | |
|---|---|
| ***F04C 2/10*** | (2006.01) |
| ***F04C 2/18*** | (2006.01) |
| ***F04C 2/14*** | (2006.01) |
| ***F04C 14/22*** | (2006.01) |
| ***F04C 14/00*** | (2006.01) |
| ***F04C 15/06*** | (2006.01) |

(52) U.S. Cl.
CPC ..... *F04C 2/18* (2013.01); *F04C 14/00* (2013.01); *F04C 14/22* (2013.01); *F04C 15/06* (2013.01); *F01M 2001/0238* (2013.01); *F01M 2001/0246* (2013.01); *F04C 2270/18* (2013.01)

(58) Field of Classification Search
CPC ..... F04C 15/06; F04C 2/084; F04C 2/102; F04C 2/14; F04C 2/18; F04C 2270/18
USPC ..... 418/61.3
See application file for complete search history.

(56) References Cited

U.S. PATENT DOCUMENTS 5,092,751 A 3/1992 Viktora
5,782,083 A * 7/1998 Hodge ..... F04C 2/102 418/61.3

FOREIGN PATENT DOCUMENTS

| | | | |
|---|---|---|---|
| EP | 2187057 | A1 | 5/2010 |
| GB | 2313411 | A | 11/1997 |
| GB | 2443088 | A | 4/2008 |
| GB | 2443089 | * | 4/2008 |
| WO | 2006134337 | A1 | 12/2006 |

* cited by examiner

METHOD FOR OPERATING A GEAR PUMP, AND GEAR PUMP

CROSS-REFERENCE TO RELATED APPLICATIONS

The present application claims priority of DE 10 2015 001 235.5 filed Feb. 3, 2015, which is incorporated herein by reference.

BACKGROUND OF THE INVENTION

The invention concerns a method for operating a gear pump, a gear pump and a vehicle, in particular a truck, and/or an internal combustion engine for performance of the method and/or with the gear pump.

It is known to deliver oil, in particular engine oil, in an oil circuit of a motor vehicle using a gear pump. The gear pump may for example be configured as an internal gear pump in which at least one externally toothed gear wheel intermeshes with at least one internally toothed gear wheel. Such an internal gear pump is normally driven via the internally toothed gear wheel. Furthermore it is also known to configure a gear pump as an external gear pump in which at least one externally toothed gear wheel intermeshes with at least one further externally toothed gear wheel. The external gear pump is here driven by at least one of these externally toothed gear wheels. The oil or fluid to be conveyed is delivered by the tooth gaps between the individual teeth of the gear wheels. These gaps form delivery chambers which deliver the fluid to be conveyed in the rotation direction of the respective gear wheel.

Furthermore, it is also known in an external gear pump to split the teeth axially or arrange at least two gear wheels behind each other viewed in the axial direction. The split teeth are then usually arranged rotated relative to each other by half a tooth pitch. In this way the amplitudes of the pressure pulses occurring on operation of the gear pump can be reduced, since the volume of the delivery chambers is diminished and the viscosity of the fluid has a damping effect when the fluid flows from one delivery chamber to the next delivery chamber. Too great an amplitude of the pressure pulses in an oil circuit can for example frequently lead to an overload of oil coolers, overpressure valves and further elements of the oil circuit.

DE 197 46 768 A1 for example discloses a gear mechanism with a drive train comprising at least two gear trains, the gear wheels of which are guided with their hubs on at least two shafts mounted rotatably in the housing. The driven gear wheels of the at least two gear pairs are arranged together on one of the shafts and coupled rotationally fixedly to this one shaft via an external toothing formed on this one shaft and an internal toothing formed in the hubs of the driven gear wheels. The external toothing of the shaft here consists of at least two toothing parts spaced apart from each other and having a tooth-offset to each other, and each assigned to one of the driven gear wheels. In this way it is simply and reliably ensured that the gear wheels are fixed to the common shaft, offset to each other by half a tooth pitch, on installation.

The twist of the split gear wheels relative to each other however has a negative effect on the suction capacity of the gear pump, and hence also on the flow rate of the gear pump, in particular because of the flow of the fluid to be conveyed from one delivery chamber to the adjacent delivery chamber.

This is a problem for example in defined operating situations of the gear pump when a gear pump is used in an oil circuit of a vehicle.

BRIEF SUMMARY OF THE INVENTION

An object of the invention is to provide a method for operating a gear pump, and a gear pump, in which operation of the gear pump is optimised in a simple and effective manner.

The object of the invention is met by a method for operating a gear pump, in particular for delivering oil in an oil circuit of a vehicle, wherein a delivery device is provided with at least two gear wheels, in particular with external toothing or configured as spur gears and arranged in a housing, and a fluid to be conveyed is delivered starting from at least one housing inlet through to at least one housing outlet, the gear wheels being arranged behind each other viewed in the axial direction. According to the invention, an adjustment device is provided, by means of which the gear wheels can be twisted and/or displaced relative to each other depending on the pressure conditions inside the housing, in particular depending on the vacuum pressure at the housing inlet and/or depending on the fluid back-pressure at the housing outlet.

In this way, operation of the gear pump is optimised in a simple and effective manner, since the gear wheels are now twisted and/or displaced relative to each other only as a function of the pressure conditions inside the housing. Via the pressure conditions inside the housing, it can be reliably determined whether or not a particularly high suction power of the gear pump, and hence a particularly high flow rate of the gear pump, is currently required. The gear wheels can then for example be twisted and/or displaced relative to each other such that the flow rate of the gear pump is particularly high, or the amplitudes of the pressure pulses of the gear pump are as low as possible. Also, the gear wheels can be moved to intermediate positions which ensure an adequate flow rate and at the same time reduced amplitudes of the pressure pulses.

The gear wheels, viewed in the axial direction, may be arranged in the housing spaced apart with a defined spacing. It is however preferred if the gear wheels arranged behind each other are in contact with each other, in order to achieve a particularly compact construction.

In a preferred embodiment, the gear wheels are arranged in the housing such that their rotation axes are oriented substantially congruent or parallel to each other, in order to configure the gear pump particularly simply and effectively. In a further embodiment, the gear wheels are axially twisted and/or displaced in the radial direction relative to each other by the adjustment device depending on the pressure conditions inside the housing. In this way, the suction capacity and the amplitudes of the pressure pulses of the gear pump can be adjusted or set simply and effectively.

In one embodiment, the gear wheels have a substantially identical radial outer contour. The gear wheels in a base position are then arranged flush with each other viewed in the axial direction. Insofar as the fluid back-pressure at the housing outlet lies below at least one defined minimum value, the gear wheels are moved into the base position, from a position not corresponding to the base position, by the adjustment device. In this base position, the suction capacity or suction power of the gear pump is at its maximum. By moving the gear wheels into the base position, it is therefore reliably ensured that the flow rate of the gear pump is at its maximum. In an oil circuit of a vehicle, this base position of the gear wheels is advantageous for example on start-up of an internal combustion engine, since the oil pressure is built up particularly quickly and air bubbles are dissipated rapidly. On such a start-up of the internal combustion engine, the fluid back-pressure at the housing outlet is particularly low. Also the base position is advantageous in an oil circuit of a motor vehicle at low rotation speeds of the gear pump and high oil temperatures, since despite the oil having a low viscosity, so-called gap losses from the flowing of oil between the delivery chambers and into the bearing points of the pump and the internal combustion engine are better compensated. In this operating situation, the fluid back-pressure at the housing outlet is also particularly low.

According to a further embodiment, insofar as the fluid back-pressure at the housing outlet does not fall below the at least one minimum value, the gear wheels arranged in the base position are twisted and/or displaced relative to each other by the adjustment device. In this way, the amplitudes of the pressure pulses are reduced when the maximum suction capacity or suction force of the gear pump is not required.

According to yet another embodiment, insofar as the fluid back-pressure at the housing outlet exceeds a defined maximum value configured greater than the minimum value, the gear wheels are moved into a maximum position in which the gear wheels are arranged twisted relative to each other by half a tooth pitch. In this maximum position, the amplitudes of the pressure pulses are particularly low. The fluid back-pressure at the housing outlet in an oil circuit of a motor vehicle is usually particularly high at high rotation speeds of the gear pump.

The object of the invention is also met by a gear pump, in particular for delivering oil in an oil circuit of a motor vehicle, with a delivery device which has at least two gear wheels, in particular with external toothing and/or configured as spur gears and arranged in a housing. The gear wheels deliver a fluid to be conveyed starting from at least one housing inlet through to at least one housing outlet, and wherein the gear wheels are arranged behind each other viewed in the axial direction, in particular with a defined spacing. According to the invention, an adjustment device twists and/or displaces the gear wheels relative to each other depending on the pressure conditions inside the housing, in particular depending on the vacuum pressure at the housing inlet and/or depending on the fluid back-pressure at the housing outlet.

The advantages resulting from the gear pump according to the invention are identical to the advantages of the method according to the invention already described, so they need not be repeated at this point.

In a preferred embodiment of the gear pump, a fixing device is provided, which fixes the at least one gear wheel forming the adjustment gear to the housing displaceably and/or twistably relative to at least one other gear wheel. In this way, the gear wheels can be twisted and/or displaced relative to each other particularly simply.

According to another embodiment, the adjustment device has at least one pretension element, which pretensions the adjustment gear in a base position. In this way the adjustment gear can be moved into the base position easily and reliably, since it is pressed or pretensioned into the base position by the pretension element. In one embodiment, the pretension element is formed by a spring element, in particular a torsion spring, in order to configure the pretension element functionally reliably and simply.

In another embodiment, the pretension element cooperates with a stop, in particular with at least one stop element, which prevents twisting and/or displacement of the adjustment gear arranged in the base position in at least one defined direction. Thus an undesirable twist and/or displacement of the adjustment gear in at least one defined direction can be reliably prevented.

In yet another embodiment, the adjustment gear arranged in the base position moves and/or twists relative to the at least one other gear wheel, starting from the base position, under defined pressure conditions in the housing. This displacement and/or twist of the adjustment gear tensions the pretension element, building up a return force. In this way the twist and/or displacement of the gear wheels relative to each other as a function of the pressure conditions inside the housing can be ensured particularly simply and reliably. In particular, it is not necessary to regulate or control the twist and/or displacement of the gear wheels in a complex, fault-susceptible manner by a regulator and/or control device. The gear pump is therefore produced particularly economically.

In a further embodiment, a stop element is provided, which limits the displacement and/or twist of the adjustment gear arranged in the base position to a defined amount. In this way, it is reliably and simply ensured that the adjustment gear can only move by a defined amount relative to the at least one other gear wheel.

In concrete terms, the gear pump may for example be configured as an internal gear pump, wherein the at least two gear wheels are formed by externally toothed gear wheels which intermesh with at least one internally toothed gear element. Preferably, the internally toothed gear element or an externally toothed gear element, which is not the adjustment gear, forms a drive gear for driving the internal gear pump, in order to be able to drive the gear pump particularly easily.

In one embodiment, the fixing device comprises a fixing element, which fixes the adjustment gear to the housing displaceably relative to the housing, wherein the adjustment gear is fixed rotatably to the fixing element so as to form a first rotation axis, wherein the fixing element is fixed rotatably to the housing so as to form a second rotation axis arranged substantially parallel to the first rotation axis, and wherein the adjustment gear can be displaced relative to the housing by turning the fixing element. In this way, the adjustment gear can be displaced and/or twisted relative to the at least one other gear wheel in a particularly simple and functionally reliable fashion. In one specific embodiment, it is provided that the fixing element is configured substantially Z-shaped, in order to configure the fixing element for optimum function.

In a further embodiment, the pretension element is tensioned by turning the fixing element in a first rotation direction. The pretension element is then released by turning the fixing element in a second rotation direction opposite the first rotation direction. In this way, the adjustment gear can be pretensioned in the base position particularly simply by means of the pretension element. The pretension element is fixed with an end region to a region of the fixing element protruding from the housing, in order to be able to attach the pretension element to the fixing element in a particularly simple manner.

In an alternative embodiment, the gear pump is configured as an external gear pump, wherein the at least two gear wheels are formed by externally toothed gear wheels and form drive gears for driving the external gear pump, and wherein each of these drive gears intermeshes with a corresponding externally toothed gear wheel.

In a preferred embodiment, the fixing device here has a drive shaft mounted rotatably on the housing for driving the drive gears, wherein at least one drive gear is connected rotationally fixedly to the drive shaft, wherein at least one drive gear forming the adjustment gear is fixed to the drive shaft axially twistably relative to the drive shaft, and wherein the drive shaft is connected to the adjustment gear in a torque-transmissive fashion by the pretension element. Thus the adjustment gear can be fastened twistably relative to the other gear wheel particularly easily.

In yet another embodiment, the pretension element is tensioned by turning the adjustment gear relative to the drive shaft in a first rotation direction. The pretension element is then released by turning the adjustment gear relative to the drive shaft in a second rotation direction opposite the first rotation direction. Thus the adjustment gear can also be pretensioned particularly simply in the base position by means of the pretension element. In a further embodiment, the pretension element is arranged between the drive gears, viewed in the axial direction, in order to achieve a particularly compact construction. Alternatively and/or additionally, the pretension element may also be arranged between the adjustment gear and a housing wall, or may protrude out of the housing.

Furthermore, the object of the invention is also met by a vehicle, in particular a truck, and/or an internal combustion engine performing the above-described method according to the invention and/or with the gear pump according to the invention. The resulting advantages are identical to the advantages of the method according to the invention and/or the gear pump according to the invention already described, so these need not be repeated at this point. The internal combustion engine may for example be configured as a stationary internal combustion engine or as a marine internal combustion engine.

The advantageous embodiments and/or refinements of the invention explained above and/or disclosed in the subclaims may be used individually or also in arbitrary combination, except for example in the case of clear dependencies or incompatible alternatives.

The invention and its advantageous embodiments and/or refinements and their advantages are explained in more detail below merely as an example, with reference to drawings.

DETAILED DESCRIPTION OF THE PREFERRED EMBODIMENTS

Figure 1:
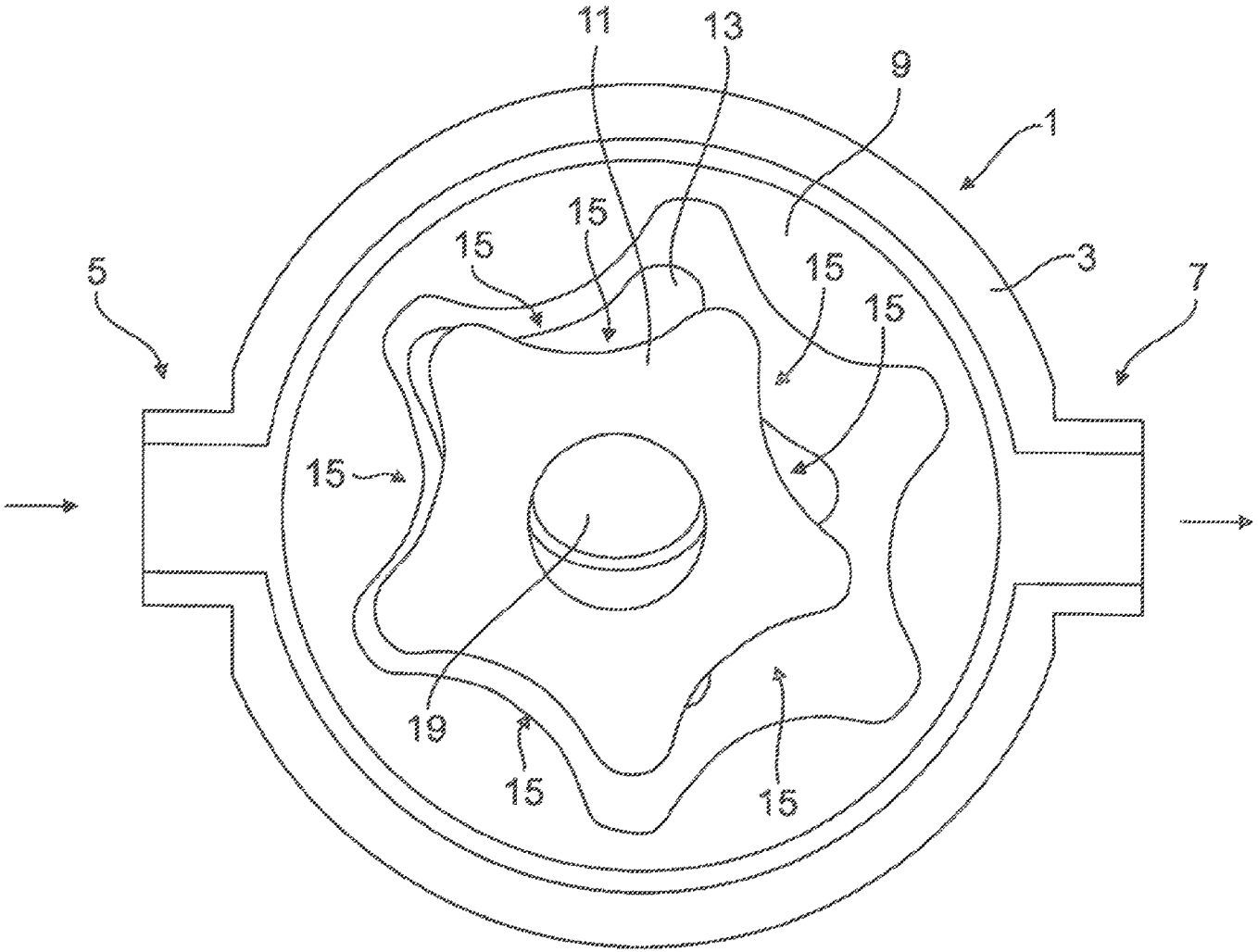
FIG. 1 is a top view of an internal gear pump according to the invention with a top of the housing removed, in a first operating situation.

FIG. 1 shows a gear pump, here formed for example as an internal gear pump 1. The internal gear pump 1 has a housing 3 which is shown open in FIG. 1, i.e. with a top removed so that the gears are visible. The housing 3 has a housing inlet 5 and a housing outlet 7. By means of the housing inlet 5 and the housing inlet 7, the internal gear pump 1 may be connected for example to an oil circuit of the vehicle, so that the oil to be conveyed by the internal gear pump 1 passes via the housing inlet 5 into the interior of the housing 3 and emerges from the housing 3 again via the housing outlet 7.

As furthermore shown in FIG. 1, the internal gear pump 1 has an internally toothed gear wheel arranged inside the housing 3 and here configured for example as a spur gear 9, which forms a drive gear for driving the internal gear pump 1. The internally toothed spur gear 9 intermeshes with a plurality of, here for example two, externally toothed gear wheels also configured as spur gears 11, 13. The externally toothed spur gears 11, 13 are here configured for example identically or with identical design, and viewed in the axial direction x (FIG. 3) are arranged behind each other in the housing 3 with a defined spacing. To drive the internal gear pump 1, the internally toothed spur gear 9 is driven rotationally by a suitable drive device, not shown in the figures. The externally toothed spur gears 11, 13 intermeshed with the internally toothed spur gear 9 are then also driven in rotation by the internally toothed spur gear 9. In this way, the fluid to be conveyed is delivered from the housing inlet 5 to the housing outlet 7 via tooth gaps 15, forming delivery chambers, of the externally toothed face spur wheels 11, 13.

According to FIG. 1, the externally toothed spur gear 13 is here fixed as an example axially rotatably on a shaft 19. The shaft 19 is here for example fixed rigidly or immovably to the housing 3. The externally toothed spur gear 11 is here for example mounted on the housing 3 displaceably and rotatably relative to the externally toothed spur gear 13 by an adjustment device 21 (FIG. 3). The externally toothed spur gear 11 may for example be arranged, by the adjustment device 21, in a base position shown in FIG. 2, in which the externally toothed spur gears 11, 13 are arranged flush with each other in the axial direction x or viewed in top view. The rotation axes of the spur gears 11, 13 are then aligned congruent to each other. Also, the externally toothed spur gear 11 may here for example also be arranged in a maximum position, in which the externally toothed spur gears 11, 13 are arranged twisted relative to each other by half a tooth pitch. FIG. 1 shows the externally toothed spur gear 11 arranged in a position between the base position and the maximum position. Here the rotation axes of the spur gears 11, 13 are then oriented parallel to each other for example.

As shown from FIG. 3, the adjustment device 21 has a fixing device 23, which fixes the gear wheel 11 forming the adjustment gear to the housing 3 movably or rotatably relative to the housing 3 and hence also to the spur gear 13. The fixing device 23 here comprises for example a substantially Z-shaped fixing element 25 which has a shaft 27, forming a first rotation axis $A_1$, on which the adjustment gear 11 is fixed axially rotatably. Also, the fixing element has a shaft 29, forming a second rotation axis $A_2$, by means of which the fixing element 25 is fixed rotatably to the housing 3. The shafts 27, 29 are here configured offset to each other such that the second rotation axis $A_2$ is arranged parallel to the first rotation axis $A_1$. By turning the fixing element 25 about the second rotation axis $A_2$, the adjustment gear 11 can thus be twisted and displaced relative to the spur gear 13.

Figure 2:
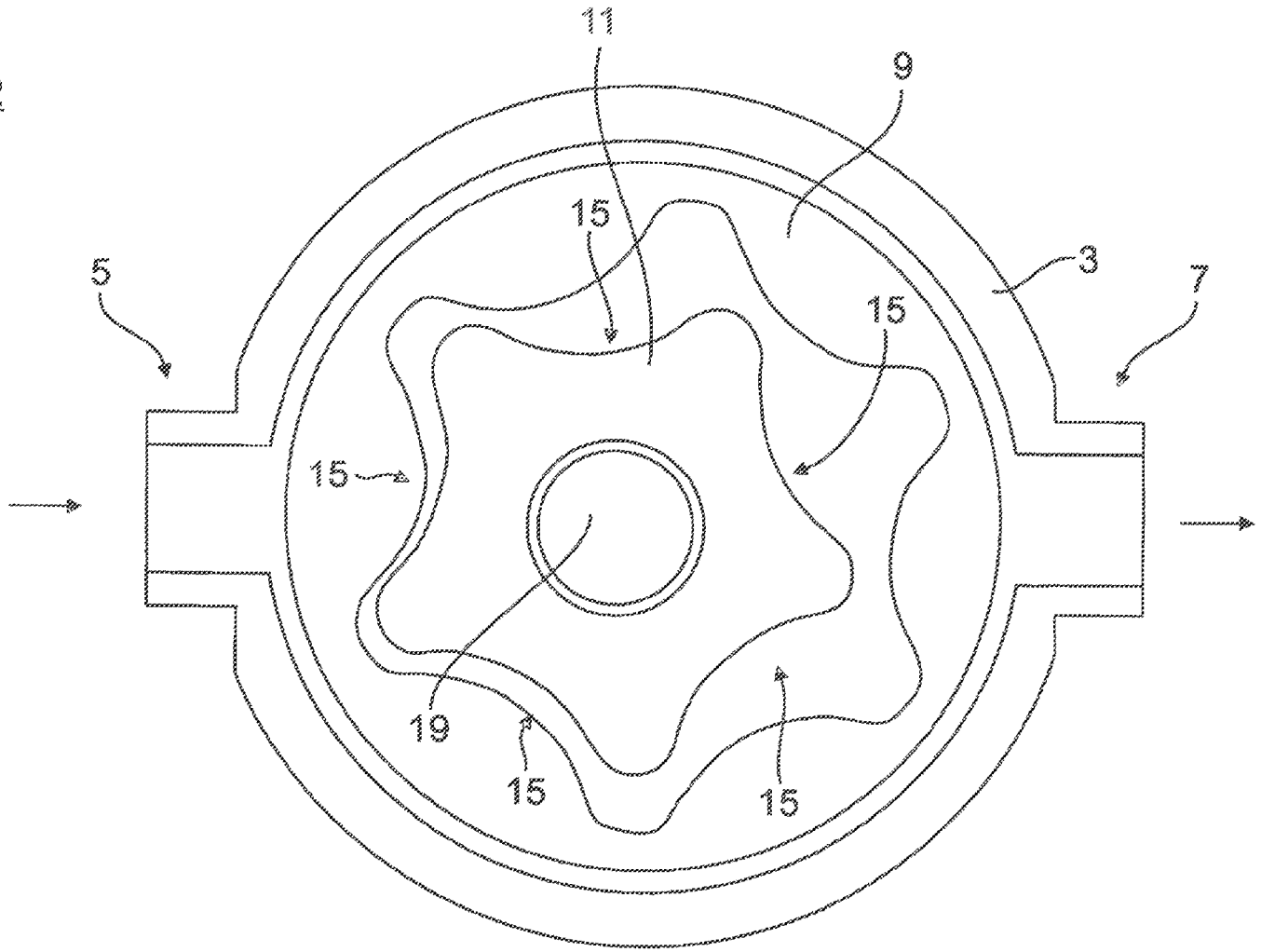
FIG. 2 is a depiction according to FIG. 1, with the internal gear pump in a second operating situation.
Figure 3:
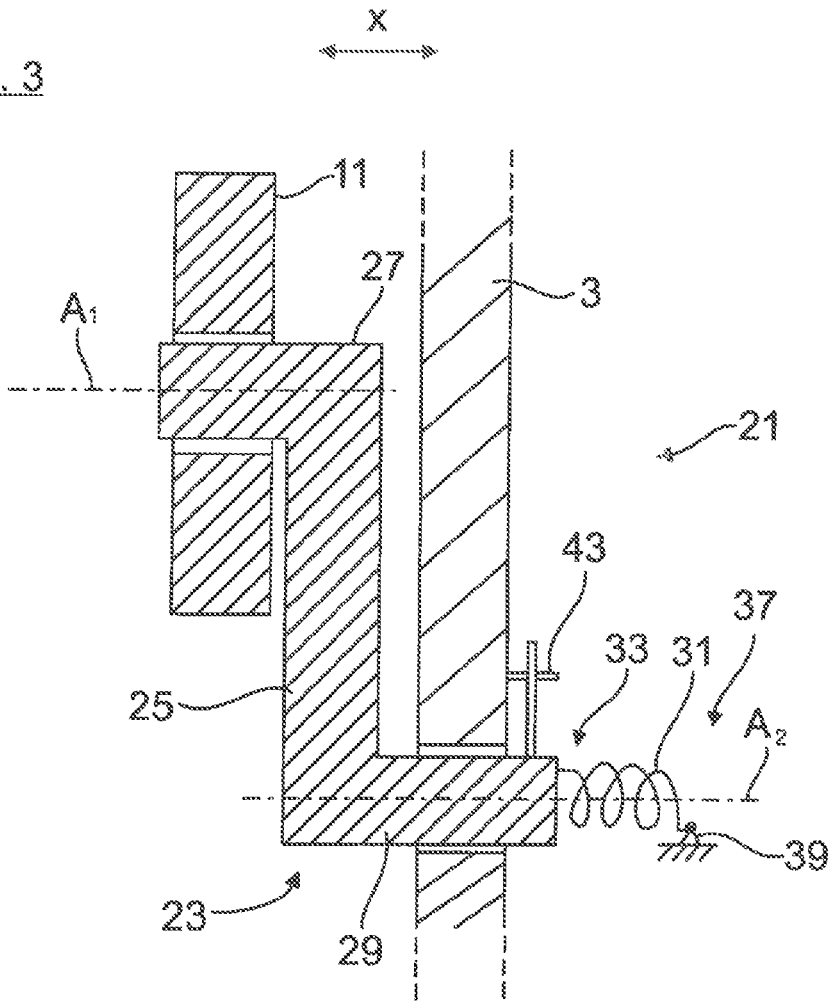
FIG. 3 is a diagrammatic section view of an adjustment device of the internal gear pump.
Figure 4:
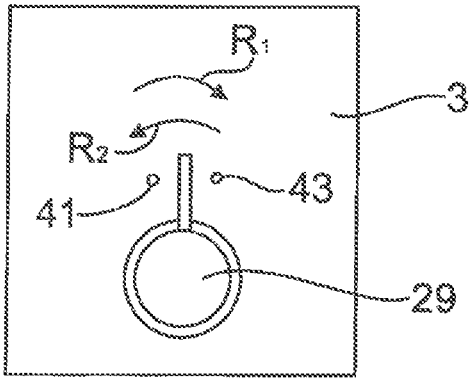
FIG. 4 is a diagrammatic depiction illustrating the function of the adjustment device of FIG. 3.

According to FIG. 3, the adjustment device 21 furthermore has a pretension element, here configured for example as a torsion spring 31, which pretensions the adjustment gear 11 in the base position (FIG. 2). The torsion spring 31 is here tensioned for example by turning the fixing element 25 about the second rotation axis $A_2$ in a first rotation direction $R_1$ (FIG. 4). By turning the fixing element 25 about the second rotation axis $A_2$ in a second rotation direction $R_2$ (FIG. 4) opposite the first rotation direction, the torsion spring 31 can be released. The torsion spring 31 is here fixed for example with an end region 33 to an end region 35 of the fixing element 25 protruding from the housing 3, and with a second end region 37 immovably or rigidly to the vehicle-side fixing point 39.

Furthermore, the adjustment element 25 is here pretensioned by the torsion spring 31 against a stop element 41, depicted diagrammatically in FIG. 4. The stop element 41 prevents a twist and/or displacement of the adjustment gear 11 arranged in the base position in the first rotation direction $R_2$. Also, the torsion spring 31 is here configured for example such that the fixing element 25 turns in the first rotation direction $R_1$ under defined pressure conditions in the housing 3. The torsion spring 31 is tensioned by this rotation, building up a return force.

As furthermore shown in FIG. 4, the adjustment device 21 also has a stop element 43, which limits the twist of the fixing element 25 in the first rotation direction $R_1$, and hence the displacement or twist of the adjustment gear 11 out of the base position, such that the adjustment gear 11 can only be displaced up to the maximum position.

Figure 5:
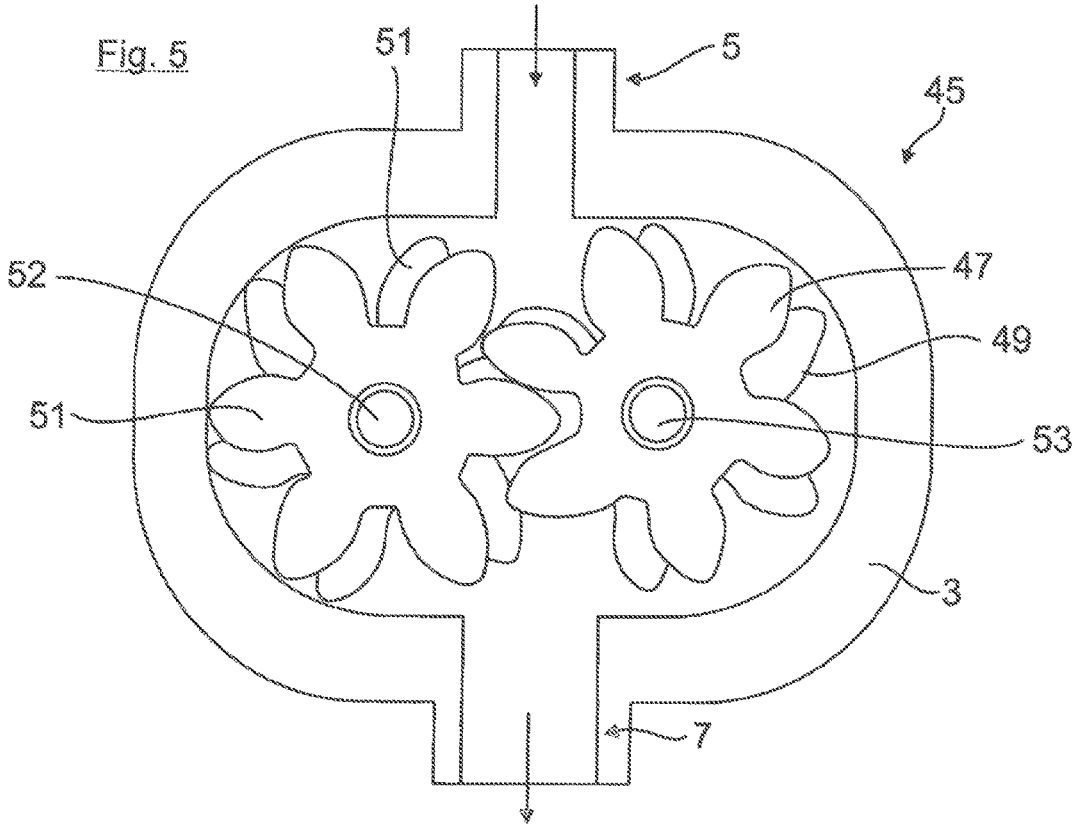
FIG. 5 is a view from above of an external gear pump according to another embodiment of the invention with a top removed from housing, in a first operating situation.
Figure 6:
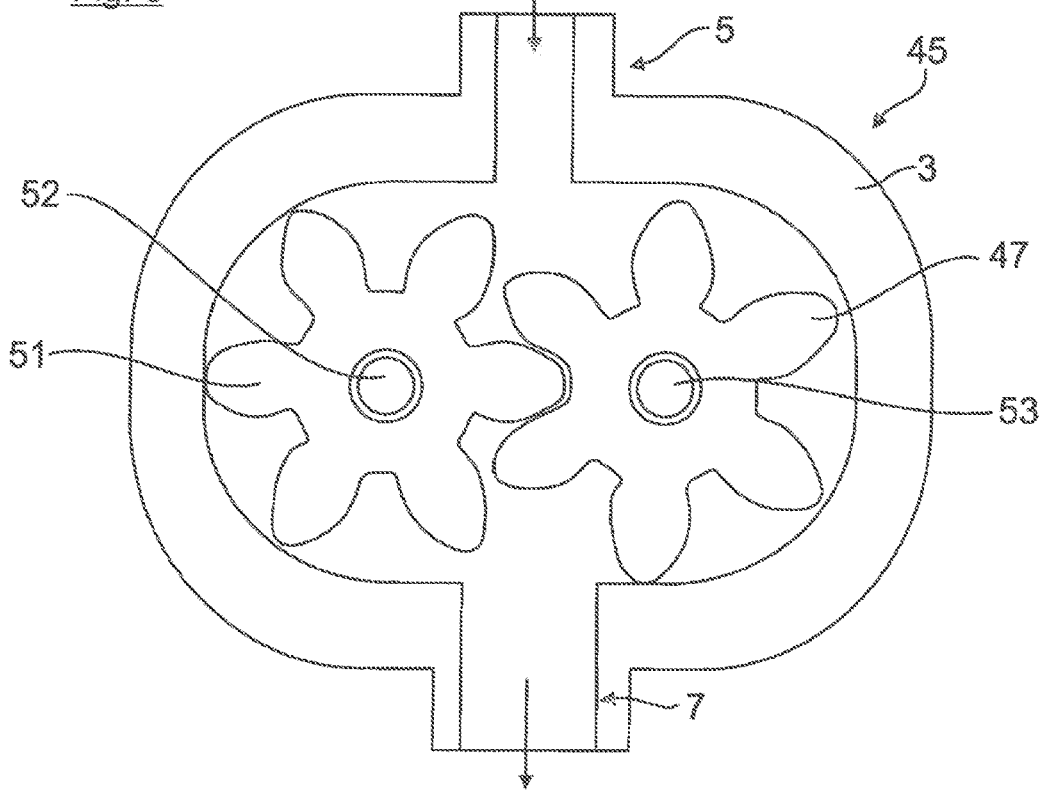
FIG. 6 is a depiction according to FIG. 5 with the external gear pump in a second operating situation.
Figure 7:
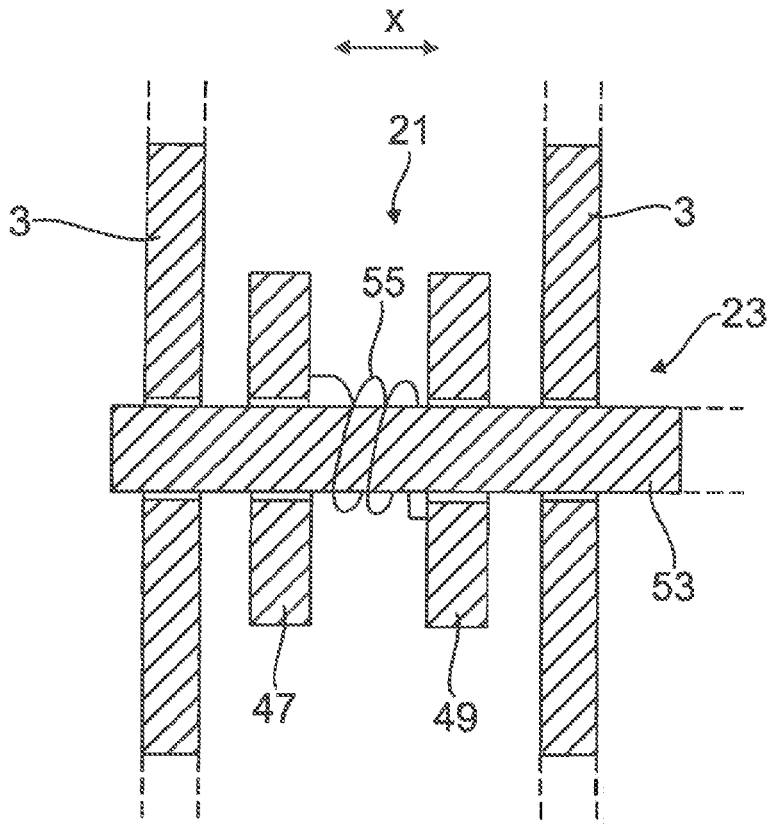
FIG. 7 is a diagrammatic section view of an adjustment device for the external gear pump.

FIGS. 5 to 7 show a second embodiment of the gear pump according to the invention. The gear pump is here configured for example as an external gear pump 45. The external gear pump 45 has a plurality of, here for example two, drive gears with external toothing, here formed as spur gears 47, 49, to drive the external gear pump 45. Each of these spur gears 47, 49 is here for example intermeshed with a corresponding gear wheel, here also configured as a spur gear 51. The spur gears 51 are here for example fixed axially rotatably to a shaft 52. The shaft 52 is here for example fixed rigidly or immovably to the housing 3. Furthermore, the spur gears 47, 49, 51 are here configured identically or with identical design.

As shown in FIG. 7, the fixing device 23 has a drive shaft 53 fixed rotatably to the housing 3 for driving the spur gears 47, 49. The spur gear 47 is here connected for example rotationally fixedly to the drive shaft 53. The spur gear 49 forming the adjustment gear is here fixed to the drive shaft 53 axially rotatably relative to the drive shaft 53. Furthermore, the two spur gears 47, 49 are here connected in a torque-transmissive fashion by a pretension element configured as a torsion spring 55. The torsion spring 55 is here arranged for example between the spur gears 47, 49 viewed in the axial direction x. The torsion spring 55 is tensioned by turning the adjustment gear 49 in a first rotation direction relative to the drive shaft 53 and hence also relative to the gear wheel 47. Also the torsion spring 55 is released by turning the adjustment gear 49 relative to the drive shaft 53 in a second rotation direction opposite to the first rotation direction.

LIST OF REFERENCE NUMERALS

1 Internal gear pump
3 Housing
5 Housing inlet
7 Housing outlet
9 Internally toothed spur gear
11 Externally toothed spur gear
13 Externally toothed spur gear
15 Tooth gap
19 Shaft
21 Adjustment device
23 Fixing device
25 Fixing element
27 Shaft
29 Shaft
31 Torsion spring
33 First end region
35 End region
37 Second end region
39 Fixing point
41 Stop element
43 Stop element
45 External gear pump
47 Spur gear
49 Spur gear
51 Spur gear
52 Shaft
53 Drive shaft
55 Torsion spring
$A_1$ First rotation axis
$A_2$ Second rotation axis
$R_1$ First rotation direction
$R_2$ Second rotation direction

The invention claimed is:

1. A method for operating a gear pump for delivering engine oil in an oil circuit of a vehicle, comprising:

providing a delivery device with at least two gear wheels arranged in a housing, the at least two gear wheels at least one of having external toothing or configured as spur gears, and are arranged behind each other viewed in an axial direction (x);

delivering a fluid to be conveyed by the gear wheels through the housing from at least one housing inlet to at least one housing outlet, at least one of twisting or displacing the gear wheels relative to each other by an adjustment device depending on pressure conditions Inside the housing, the pressure conditions being at least one of a vacuum pressure at the housing inlet and a fluid back-pressure pt the housing outlet, wherein the adjustment device includes a fixing device connecting a first gear wheel of the gear wheels forming an adjustment gear to the housing, wherein the adjustment gear is at least one of displaceable and twistable relative to a second gear wheel of the gear wheels by the fixing device, and the adjustment device has a torsion spring that pretensions the adjustment gear toward a base position, and wherein the gear wheels have a identical radial outer contour, the gear wheels in a base position are arranged flush with each other viewed in the axial direction (x), and the step of at least one of twisting and displacing includes moving the gear wheels into the base position, from a position not corresponding to the base position, by the adjustment device when the fluid back-pressure at the housing outlet lies below a minimum value.

2. The method according to claim 1, wherein the gear wheels are arranged in the housing such that rotation axes of the gear wheels are oriented parallel to each other.

3. The method according to claim 1, wherein the step of at least one of twisting and displacing includes at least one of axially twisting the gear wheels and displacing the gear wheels in the radial direction relative to each other by the adjustment device depending on the pressure conditions inside the housing.

4. The method according to claim 1, wherein, when the fluid back-pressure at the housing outlet is not below the minimum value, the step of at least one of twisting and displacing the gear wheels includes at least one of twisting and displacing the gears wheels out of the base position by the adjustment device.

5. The method according to claim 4, wherein, when the fluid back-pressure at the housing outlet exceeds a defined maximum value, the step of at least one of twisting and displacing includes moving the gear wheels into a maximum position in which the gear wheels are arranged twisted relative to each other by a half tooth pitch, the maximum value being greater than the minimum value.

6. A gear pump for delivering engine oil in an oil circuit of a motor vehicle, comprising:

a delivery device including at least two gear wheels arranged in a housing, the gear wheels at least one of having an external toothing and configured as spur gears, the gear wheels being configured to deliver a fluid to be conveyed through the housing from at least one housing inlet to at least one housing outlet, and the gear wheels being arranged behind each other in the axial direction (x); and an adjustment device configured to at least one of twist and displace the gear wheels relative to each other depending on pressure conditions inside the housing, the pressure conditions being at least one of a vacuum pressure at the housing inlet and a fluid back-pressure at the housing outlet, wherein the adjustment device includes a fixing device connecting a first gear wheel of the gear wheels forming an adjustment gear to the housing, wherein the adjustment gear is at least one of displaceable and twistable relative to a second gear wheel of the gear wheels by the fixing device, and the adjustment device has a torsion spring that pretensions the adjustment gear toward a base position, wherein the gear pump is an internal near pump and the at least two gear wheels are externally toothed gear wheels which intermesh with at least one internally toothed gear element.

7. The gear pump according to claim 6, further comprising at least one stop cooperating with the torsion spring to prevent the twisting and displacement of the adjustment gear arranged in the base position in at least one defined direction.

8. The gear pump according to claim 6, wherein the adjustment gear at least one of moves and twists from the base position relative to the second gear wheel under the defined pressure conditions in the housing, and the torsion spring is tensioned by this displacement and/or twist of the adjustment gear from the base position and generates a return force.

9. The gear pump according to claim 6, further comprising a stop that limits at least one of a displacement and a twist of the adjustment gear from the base position.

10. The gear pump according to claim 6, wherein the fixing device comprises a fixing element connecting the adjustment gear to the housing displaceably relative to the housing, wherein the adjustment gear is fixed rotatably to the fixing element so as to form a first rotation axis ($A_1$), the fixing element is fixed rotatably to the housing so as to form a second rotation axis ($A_2$) arranged parallel to the first rotation axis ($A_1$), and the adjustment gear is displaceable relative to the housing by rotating the fixing element.

11. The gear pump according to claim 10, wherein the fixing element is Z-shaped.

12. The gear pump according to claim 10, wherein the torsion spring is tensioned by rotating the fixing element in a first rotation direction ($R_1$) about the second rotation axis ($A_2$), and the torsion spring can be released by rotating the fixing element in a second rotation direction ($R_2$) opposite the first rotation direction ($R_1$).

13. The gear pump according to claim 12, wherein an end region of the torsion spring is connected to a region of the fixing element protruding from the housing.

14. A vehicle with an internal combustion engine including a gear pump according to claim 6.

15. A gear pump for delivering engine oil in an oil circuit of a motor vehicle, comprising:

a delivery device including at least two gear wheels arranged in a housing, the gear wheels at least one of having an external toothing and configured as spur gears, the gear wheels being configured to deliver a fluid to be conveyed through the housing from at least one housing inlet to at least one housing outlet, and the gear wheels being arranged behind each other in the axial direction (x); and an adjustment device configured to at least one of twist and displace the gear wheels relative to each other depending on pressure conditions inside the housing, the pressure conditions being at least one of a vacuum pressure at the housing inlet and a fluid back-pressure at the housing outlet, wherein the adjustment device includes a fixing device connecting a first gear wheel of the gear wheels forming an adjustment gear to the housing, wherein the adjustment gear is at least one of displaceable and twistable relative to a second gear wheel of the gear wheels by the fixing device, and the adjustment device has a torsion spring that pretensions the adjustment gear toward a base position, and wherein the gear pump is an external gear pump, the at least two gear wheels including externally toothed gear wheels forming drive gears for driving the external gear pump, and each of the drive gears intermeshing with a corresponding externally toothed gear wheel.

16. The gear pump according to claim 15, wherein the fixing device includes a drive shaft mounted rotatably on the housing for driving the drive gears, wherein at least one of the drive gears is connected rotationally fixedly to the drive shaft, and at least another of the drive gears forming the adjustment gear is fixed to the drive shaft axially twistably relative to the drive shaft, and wherein the drive gears are connected in a torque-transmissive fashion by the torsion spring.

17. The gear pump according to claim 16, wherein the torsion spring is tensioned by rotating the adjustment gear relative to the drive shaft in a first rotation direction, and the torsion spring can be released by rotating the adjustment gear relative to the drive shaft in a second rotation direction opposite the first rotation direction.

* * * * *